United States Patent [19]

Mikos

[11] 3,971,242

[45] July 27, 1976

[54] KEY EJECTOR LOCK

[75] Inventor: Aloysius J. Mikos, Skokie, Ill.

[73] Assignee: Chicago Lock Co., Chicago, Ill.

[22] Filed: July 25, 1975

[21] Appl. No.: 599,154

[52] U.S. Cl. ..... 70/388; 70/363

[51] Int. Cl.[2] ..... E05B 17/00; E05B 27/08

[58] Field of Search ..... 70/346, 347, 349, 356, 70/360, 363, 388, 414

[56] References Cited

UNITED STATES PATENTS

| | | | |
|---|---|---|---|
| 240,397 | 4/1931 | Elmer | 70/156 |
| 3,524,335 | 8/1970 | George | 70/363 |
| 3,661,001 | 5/1972 | Glass | 70/388 |

FOREIGN PATENTS OR APPLICATIONS

| | | | |
|---|---|---|---|
| 7,191 | 3/1907 | United Kingdom | 70/388 |

*Primary Examiner*—Robert L. Wolfe
*Attorney, Agent, or Firm*—Norman H. Gerlach

[57] ABSTRACT

A key ejector lock adapted for use in the door of a cabinet or other enclosure and which will eject the lock key in any rotational position thereof comprises a tubular barrel, a front end plug rotatable in the barrel and having a keyway extending therethrough, a rear end plug rotatable in the barrel and adapted for connection to a locking member, rotatable drive means interposed between the plugs for driving the rear end plug, means providing a sliding drive connection between the front end plug and the drive means, one member of the front end plug and the drive means being mounted for axial reciprocal movement in the barrel, means resiliently urging the one member forwardly in the barrel, means on the barrel providing rearwardly opening internal notches, lug means projecting outwardly from the one member and removably received in the notches for securing the rear end plug in respective locked and unlocked rotational positions, a key ejector axially reciprocally movable in the barrel between the front end plug and the drive means and engaging a key inserted through the keyway, and means resiliently urging the key ejector forwardly in the barrel, whereby insertion of a key in the keyway serves to move the one member rearwardly to free the rotatable parts for rotation and enable the key to rotate the front end plug for rotating the rear end plug between the locked and unlocked positions thereof.

13 Claims, 4 Drawing Figures

KEY EJECTOR LOCK

BACKGROUND OF THE INVENTION

This invention relates to a key ejector lock for the door of a cabinet or other enclosure, particularly, for a refrigerator or freezer door.

Locks are employed on refrigerator and freezer cabinets for the purpose of preventing minors from obtaining access to the cabinets and, especially, to prevent minors from entering and becoming locked in the cabinets. The locks are low security locks, in that they do not embody key-operable tumblers. Instead, they have simpler key-operable mechanism for alternately securing and releasing for rotation a rotatable plug part movable between locked and unlocked positions. A characteristic of the locks is that they are designed to automatically eject the key when it is released, so that the key does not remain in the lock, where it is accessible to a minor. Preferably, the key is ejected in any rotational position thereof, so that under no circumstances will it remain in the lock. Such a lock is disclosed in U.S. Pat. No. 3,661,001.

SUMMARY OF THE INVENTION

An important object of the present invention is to provide a key ejector lock constructed of fewer parts, thereby facilitating and reducing the cost of producing the parts and assembling them in a lock.

Another object is to provide a key ejector lock which is more readily assembled by virtue of the construction of its parts, and, in particular, is assembled from the rear end of the lock. An accompanying object is to provide a lock in which a rear end plug is inserted in the barrel into snap-fitting interengagement therewith, to secure the several parts in the lock.

An additional object is to provide a lock structure wherein the rear end plug is mounted in the lock barrel so as to minimize axial play and side play, to afford a tight, secure closure and minimize the required latching tolerances.

In its broader aspects, the key ejector lock of the invention includes a tubular barrel, a front end plug rotatably mounted in the barrel and having a keyway extending therethrough for operation thereof by a key, a rear end plug rotatably mounted in the barrel and adapted for operative connection to a locking member, rotatable drive means interposed between the plugs and drivingly engaging the rear end plug, means providing a sliding drive connection between the front end plug and the drive means, one member of said front end plug and the drive means being mounted for axial reciprocal movement in the barrel, means resiliently urging the one member forwardly in the barrel, means on the barrel providing rearwardly opening circumferentially spaced internal notches, lug means projecting outwardly from the one member, such lug means being removably received in respective ones of the notches for securing the rear end plug in respective locked and unlocked rotational positions, a key ejector axially reciprocally movable in the barrel between the front end plug and the drive means and engaging a key inserted through the keyway, and means resiliently urging the key ejector forwardly in the barrel, whereby insertion of a key in the keyway serves to move the one member rearwardly to free the rotatable parts for rotation and enable the key to rotate the front end plug for rotating the rear end plug between the locked and unlocked positions thereof, and the key ejector acts to eject the key when released in any rotational position thereof.

In a preferred embodiment of the invention, providing the rear end-loading, snap-fitting and minimal play features, the barrel is provided with an internal retaining shoulder adjacent its front end, the rear end of the barrel is slit longitudinally to provide for resilient expansion thereof, and the barrel on its slit end and the rear end plug are provided with interengaging circumferential ring and groove means enabling relative rotation thereof, whereby the lock may be assembled by loading the barrel from its rear end with the rear end plug inserted in the barrel into snap-fitting interengagement of the ring and groove means to secure the several parts in the lock.

In an additionally preferred embodiment, providing additional minimization of side play and also providing a vapor barrier, a circumferential groove is provided on the rear end plug forwardly beyond the slit portion of the barrel when assembled, and an O-ring is mounted in such groove.

In a further preferred embodiment, the notch means on the barrel provide at least two circumferentially spaced notches corresponding respectively to the locked and unlocked positions of the rear end plug, and at least one intervening notch in which the lug means is received when the key is ejected at a transitional position of said rear end plug between the locked and unlocked positions, to thereby prevent movement of the rear end plug into the locked position.

In a specific preferred embodiment, the drive means constitutes the one member mounted for axial movement, and the drive means slidably engages the rear end plug. The security of such embodiment is increased by virtue of the relative inaccessibility of the drive means, which must be operated before the key can be rotated to operate the front end plug for unlocking and locking purposes.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
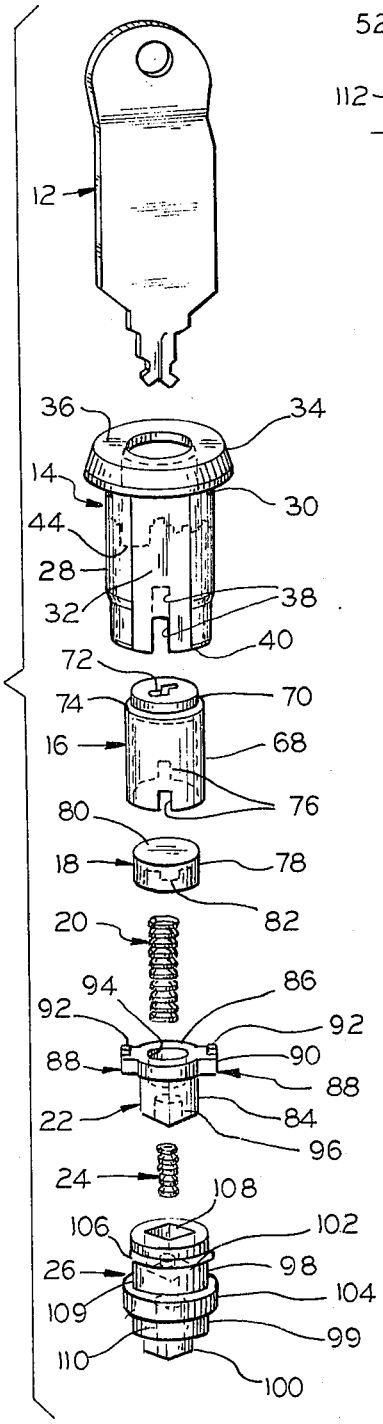
FIG. 1 is an exploded perspective view of a key ejector lock and a key therefor, according to the invention.
Figure 2:
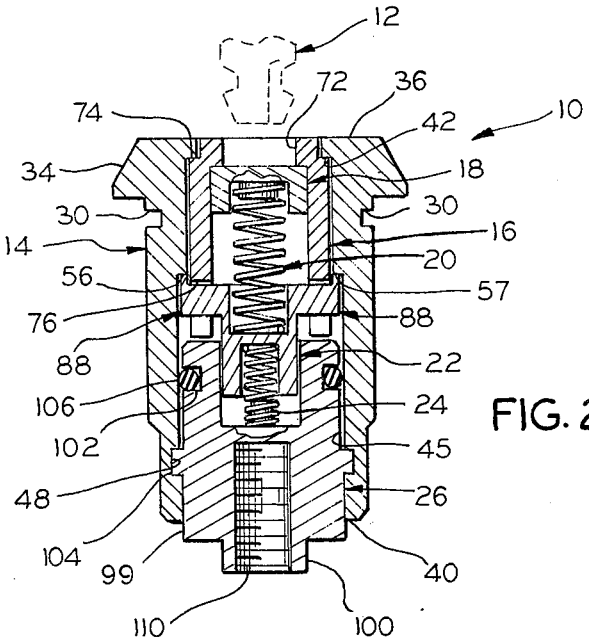
FIG. 2 is an enlarged axial sectional view of the lock in an initial condition.
Figure 3:
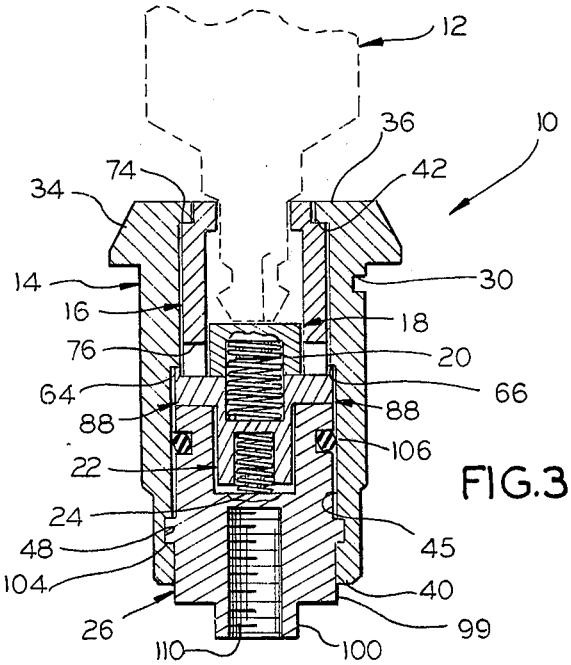
FIG. 3 is a view similar to FIG. 2 but with the lock in a transitional condition.

Referring to FIGS. 1–3 of the drawings, a lock and key assembly according to the invention includes a lock 10 of cylindrical construction and a flat-type key 12. The lock 10 includes a generally cylindrical tubular barrel 14, a generally cylindrical tubular front end plug 16, a cylindrical cup-like key ejector 18, a relatively light coil compression spring 20, an elongated driver or drive means 22, a relatively heavy coil compression spring 24, and a generally cylindrical rear end plug 26. The lock 10 thus has five principal parts, exclusive of the springs.

The barrel 14 includes a generally cylindrical tubular body 28 having on its outer surface, for mounting purposes, a pair of diametrically opposed transverse grooves 30, a pair of diametrically opposed flats 32 between the grooves, and a circular flange 34 around the front end of the body 28. Two diametrically opposed longitudinal slits or slots 38 are provided in respective flats 32, in the rear end 40 of the barrel. The slits 38 provide for resilient expansion of the body 28 at the rear end 40, for a purpose subsequently described.

The inner surface of the body 28 is recessed adjacent the front end 36 of the barrel 14, to provide an annular internal retaining shoulder 42. The inner surface of the body 28 is further recessed in axially spaced relation to the shoulder 42, to form a circumferential shouldered portion 44, which projects inwardly from the remaining portion 45 of the body 28, disposed rearwardly thereof. An internal circumferential retaining groove 48 is provided in the slit portion of the barrel 14, intermediate the ends of the slits 38. The groove 48 is substantially rectangular in cross section.

Figure 4:
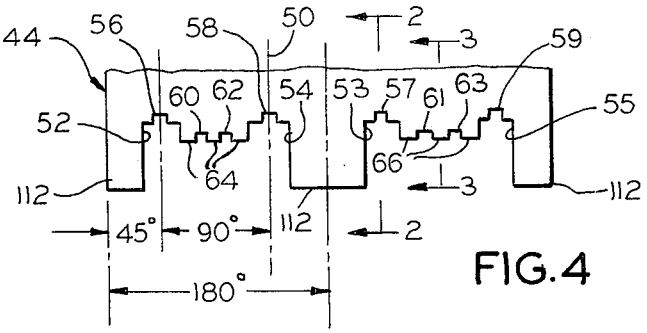
FIG. 4 is a developed internal view of a portion of the body of the lock barrel.

FIG. 4 is a fragmentary developed view of the shoulder portion 44, and the axis 50 identified in FIG. 4 corresponds to the centerline of FIG. 2. The right half of FIG. 2 illustrates the shouldered portion 44 as seen when viewed as a section taken on line 2—2 of FIG. 4, and similarly, the right half of FIG. 3 illustrates the shouldered portion 44 when viewed as a section taken on line 3—3 of FIG. 4.

The shouldered portion 44 is provided with a series of longitudinally extending notches, in spaced relation around the barrel 14. Four principal notches 52–55 are provided, and they constitute two pairs of locking and unlocking notches, respectively. For convenience, the notches 52, 53 of one pair will be identified as the locking notches, and the notches 54, 55 of the remaining pair will be identified as the unlocking notches, although their functions may be interchanged. Each of the principal notches 52–55 includes a detent notch 56–59, respectively. The principal notches 52–55 are angularly spaced apart around the barrel on 90° centers, and the notches in each pair 52, 53 and 54, 55 are angularly spaced apart on 180° centers.

The areas of the shouldered portion 44 between the non-paired adjacent principal notches 52, 54 and 53, 55 are notched to provide two pairs of diametrically opposed intervening notches 60, 61 and 62, 63 bordered by shoulders 64 and 66. The intervening notches 60–63 are angularly spaced from the adjacent principal notches 52–55 and from each other on 30° centers.

The front end plug 16 is rotatably mounted in the barrel 14. The front end plug 16 includes a cylindrical tubular side wall 68 received within the shouldered portion 44 of the barrel body 28, and a circular front end wall 70 received in the body 28 at the front end 36. A non-linear or irregular keyway 72 extends through the front end wall 70 in communication with the interior of the side wall 68. The end wall 70 has a reduced diameter with respect to the side wall 68, thereby forming a shoulder 74 which engages the retaining shoulder 42 on the body 28, for retention of the front end plug 16 within the barrel at the front end 36 thereof. A pair of diametrically opposed slots 76 extend longitudinally in the side wall 68 of the front end plug 16 from the rear end thereof.

The key ejector 18 includes a cylindrical tubular side wall 78 and a circular front end wall 80. A pilot stem 82 projects from the inner surface of the end wall 80, centrally of and spaced from the side wall 78.

The driver 22 includes a square body 84 surmounted by a circular head 86 at the front end of the driver. Two lug means 88 are integral with the head 86 and extend radially outwardly therefrom in diametrically opposed relation. Each lug means includes a rectangular lug proper 90 and a rectangular detent 92 on the front surface of the lug proper. The lug means 88 conform to the outline of the principal notches 52–55 in the shouldered portion 44, and the detents 92 conform to the outlines of the detent notches 56–59 and the intervening notches 60–63. The lugs 90 conform to the outline of the slots 76 in the front end plug 16. A front spring bore 94 extends longitudinally in the driver 22 from the front end thereof, and a rear spring bore 96 extends longitudinally in the driver from the rear end thereof.

The rear end plug 26 includes a cylindrical body 98 having a rear end 99 of enlarged diameter, and a square stem 100 projecting integrally from the rear end 99. A circumferential groove 102 is provided in the outer surface of the body 98 adjacent the front end thereof, and a circumferential mounting ring 104 of rectangular cross section is provided on the body adjacent the rear end 99 thereof and integral therewith. An O-ring 106 is mounted in the groove 102 for sealing purposes. The mounting ring 104 is complementary to the retaining groove 48 in the barrel 14, the ring having but slightly smaller dimensions than the groove. A rectangular slideway 108 is formed in the body 98, extending inwardly from the front end thereof, and its cross sectional dimensions are substantially the same as those of the driver body 84, for slidably receiving the driver body therein. A pilot stem 109 is centered on the bottom of the slideway. A tapped hole 110 extends through the stem 100 and into the body 98.

When the lock 10 is assembled with the key 12 removed, as illustrated in FIG. 2 for one condition of the lock, the front end plug 16 is received in the barrel 14 with the plug shoulder 74 abutting the barrel retaining shoulder 42. The rear end plug 26 is received in the barrel 14 with the mounting ring 104 received in the retaining groove 48 and the O-ring 106 sealingly engaging the rear body portion 45 forwardly beyond the slits 38. The front end plug 16 is seated on the rear end plug 26, and both plugs are rotatable in the barrel.

The driver 22 is interposed between the front and rear end plugs 16 and 26 and is mounted for axial reciprocal movement in the barrel 14. The body 84 of the driver is received in the slideway 108 of the rear end plug 26, thereby providing a sliding drive connection between the driver and the rear end plug. The lug means 88 are received in the slots 76 in the front end plug 16, thereby providing a sliding drive connection between the front end plug and the driver 22. The heavy coil compression spring 24 is interposed between the rear end plug 26 and the driver 22 and resiliently urges the driver forwardly in the barrel. Thus, the heavy spring 24 is received around the pilot stem 109 in the slideway 108 and in the rear spring bore 96 in the driver 22.

The key ejector 18 is received in the front end plug 16 for axial reciprocal movement therein and in the barrel 14, between the front end plug and the driver 22. The key ejector is engaged by a key 12 inserted through the keyway 72. The light coil compression spring 20 is interposed between the driver 22 and the key ejector 18 and resiliently urges the key ejector forwardly in the front end plug 16 and in the barrel 14. Thus, the light spring 20 is received in the front spring bore 94 in the driver and within the wall 78 and around the pilot stem 82 in the key ejector.

The lug means 88 are removably received in the locking notches 52, 53 and the unlocking notches 54, 55, for securing the read end plug 26 in respective locked and unlocked rotational positions. Thus, in the locked position of the rear end plug 26, one lug means 88 is received in one locking notch 52, with the lug detent 92 received in the detent notch 56, and the remaining lug means 88 is received in the opposite locking notch 53 with the lug detent 92 received in the detent notch 57, as illustrated in FIG. 2. When the driver 22 is rotated 90° in the clockwise direction (as viewed from the front end 36), the lug means 88 are received in the unlocking notches 54 and 55 in like manner. The illustrative arrangement thus provides for 90° rotation of the rear end plug 26 between locked and unlocked positions. A locking cam, latch or the like, not illustrated, which is secured on the stem 100 of the rear end plug 26 by means of a screw inserted in the tapped hole 110 likewise is rotated 90° between a locked or latched position and an unlocked position.

In order to rotate the driver 22, it is necessary to move it rearwardly for a distance sufficient for the lug detents 92 to clear the shoulders 64 and 66 of the shouldered portion 44, after which the driver may be rotated by operation of the key 12, as subsequently explained. Rotation of the driver 22 to a position wherein the lug detents 92 are beneath the notch shoulders 64 and 66 is illustrated in FIG. 3. In this view, the barrel 14 is rotated 45° counterclockwise with respect to its position in FIG. 2, or put another way, the rotatable parts of the barrel have been rotated 45° in the clockwise direction with respect to the barrel.

Rotation of the driver 22 beyond 90° is prevented by the unnotched areas 112 of the shouldered portion 44, which project rearwardly beyond the notch shoulders 64 and 66. The intervening notches 60–63 are adapted for receiving the lug detents 92 when the driver 22 is rotated to an extent, less than 90°, corresponding to the angular spacing of the respective intervening notches. The intervening notches 60–63 are spaced so as to hold the rear end plug 26 in a transitional position between the locked and unlocked positions, in which a locking cam mounted on the rear end plug is removed from locking engagement with a keeper or the like on the cabinet but is not fully retracted into its ultimate unlocked position.

Insertion of the key 12 in the keyway 72 serves to move the key ejector 18 rearwardly into abutting engagement with the driver 22 to thereby move the lug means 88 rearwardly of the principal notches 52–55, and also rearwardly of the intervening notches 60–63, beyond the notch shoulders 64 and 66. The rotatable parts, including the front end plug 16, the driver 22, and the rear end plug 26, are freed for rotation, enabling the key to rotate the front end plug 16 for rotating the driver 22 and thereby the rear end plug 26 between the locked and unlocked positions of the latter.

When the key 12 is released, the heavy spring 24 urges the driver 22 forwardly, so that the lug means 88 engage the barrel 14 in one of the diametrically opposed pairs of principal notches 52–55 and intervening notches 60–63, depending upon the rotational position of the drive 22, to secure the rear end plug 26 against rotation. Ordinarily, the driver 22 will be rotated 90° between the locked and unlocked positions, with the lug means 88 engaged in the locking notches 52, 53 or the unlocking notches 54, 55 upon release of the key. The intervening notches 60–63 are provided as a safety measure, so that in the event that the key 12 is released between the locked and unlocked positions of the rear end plug 26, the lug means 88 will be engaged in the intervening notches to prevent unintended restoration of the rear end plug 26 to its locked position.

The light spring 20 bears on the key ejector 18 to exert constant pressure on the key 12 in the direction of the front end 36, so that any time the key is released, and in any rotational position thereof, the key will be propelled out of the keyway 72 and not allowed to remain in the lock. It is expected that the key then will be put away, inaccessible to minors.

In the preferred illustrative embodiment, the barrel 14, the front end plug 16, the key ejector 18, the driver 22, and the rear end plug 26 are constructed of plastic, each part being molded or otherwise formed integrally in one piece, although the parts may be constructed of other materials. Preferably, the parts are constructed of synthetic thermoplastic material, such as nylon or acetal resin. The O-ring 106 is constructed of suitable elastomeric material.

The lock 10 is assembled by loading the barrel 14 from its rear end 40, inserting, in order, the front end plug 16, the ejector 18, the light spring 20, the driver 22, the heavy spring 24, and the rear end plug 26. The rear end 40 of the barrel 14 is resiliently expanded or spread, to permit entry of the mounting ring 104 of the rear end plug 26 into the barrel. When the mounting ring 104 reaches the retaining groove 48 in the barrel, the ring snaps into the groove as the end of the barrel returns to its original configuration. In this manner, the parts are secured in the lock with but simple operations.

The manner of mounting the rear end plug 26 results in very little axial and side play, in contrast to prior structure in which accumulated tolerances result in undesirable play. Thus, the mounting ring 104 fits relatively snugly in the retaining groove 48, to minimize both axial and side play. The diameter of the rear end 99 of the rear end plug 26 is the same as or slightly greater than the internal diameter of the barrel body portion 45, resulting in a tight fit that further minimizes side play. An especially tight fit may be achieved in the foregoing ways with plastic parts and by virtue of the slits 38 in the barrel 14. Provision of the O-ring 106, spaced from the mounting ring 104, additionally reduces side play while establishing a vapor barrier between the rear end 40 of the barrel, inside the cabinet, and the front end 36 of the barrel, outside of the cabinet.

The illustrative embodiment of the invention is preferred as providing increased security against operation of the lock without a proper key. Thus, the driver 22 must be moved rearwardly before the lock can be operated, and it is spaced from the front wall 70 of the front end plug 16 and concealed behind the wall. The keyway 72 may be designed to make it difficult to insert an instrument other than a key 12 which is suitable for moving the driver against the pressure of the heavy spring 24 and then rotating the front end plug 16.

The invention in its broader aspects also includes a key ejector lock such as disclosed in my copending application Serial No. 599,190, filed on July 25, 1975.

The lock disclosed in the copending application, while not affording the degree of security afforded by the present embodiment, is constructed of still fewer parts. Consequently, the lock may be made available at lower cost while providing security comparable to other locks in use.

It will be apparent to those skilled in the art that various other changes and modifications may be made within the spirit and scope of the invention. It is intended that all such changes and modifications be included within the scope of the appended claims.

Having thus described the invention, what I claim as new and desire to secure by Letters Patent is:

1. A key ejector lock which comprises:

a tubular barrel, a front end plug rotatably mounted in said barrel and having a keyway extending therethrough for operation thereof by a key, a rear end plug rotatably mounted in said barrel and adapted for operative connection to a locking member, rotatable drive means interposed between said plugs and drivingly engaging said rear end plug, means providing a sliding drive connection between said front end plug and said drive means, one member of said front end plug and said drive means being mounted for axial reciprocal movement in said barrel, means resiliently urging said one member forwardly in said barrel, means on said barrel providing rearwardly opening circumferentially spaced internal notches, lug means projecting outwardly from said one member, said lug means being removably received in respective ones of said notches for securing said rear end plug in respective locked and unlocked rotational positions, a key ejector axially reciprocally movable in said barrel between said front end plug and said drive means and engaging a key inserted through said keyway, and means resiliently urging said key ejector forwardly in said barrel, whereby insertion of a key in said keyway serves to move said one member rearwardly to free the rotatable parts for rotation and enable the key to rotate said front end plug for rotating said rear end plug between said locked and unlocked positions thereof, and said key ejector acts to eject the key when released in any rotational position thereof.

2. A key ejector lock as defined in claim 1 and wherein said front end plug is a tubular member receiving said key ejector for axial movement therein, said first-named resilient means comprises a relatively heavy compression spring interposed between said rear end plug and said one member, and said last-named resilient means comprises a relatively light compression spring interposed between said rear end plug and said key ejector.

3. A key ejector lock as defined in claim 1 and wherein said notch means provides at least two circumferentially spaced notches corresponding respectively to said locked and unlocked positions of said rear end plugs, and at least one intervening notch in which said lug means is received when the key is ejected at a transitional position of said rear end plug between the locked and unlocked positions, to thereby prevent movement of the rear end plug into the locked position.

4. A key ejector lock as defined in claim 1 and wherein said barrel is provided with an internal retaining shoulder adjacent its front end, the rear end of said barrel is slit longitudinally to provide for resilient expansion thereof, and said barrel on its slit end and said rear end plug are provided with interengaging circumferential ring and groove means enabling relative rotation thereof, whereby the lock may be assembled by loading the barrel from its rear end with the rear end plug inserted in the barrel into snap-fitting interengagement of said ring and groove means to secure the several parts in the lock.

5. A key ejector lock as defined in claim 4 and including means providing a circumferential groove on said rear end plug disposed forwardly beyond the slit portion of said barrel when assembled, and an O-ring mounted in the latter groove to provide a vapor barrier and minimize side play of the rear end plug.

6. A key ejector lock as defined in claim 1 and wherein said drive means constitutes said one member mounted for axial movement, and said drive means slidably engages said rear end plug.

7. A key ejector lock as defined in claim 6 and wherein said front end plug is a tubular member receiving said key ejector for axial movement therein, said first-named resilient means comprises a relatively heavy compression spring interposed between said rear end plug and said drive means, and said last-named resilient means comprises a relatively light compression spring interposed between said drive means and said key ejector.

8. A key ejector lock as defined in claim 7 and wherein insertion of a key in said keyway serves to move said key ejector rearwardly into abutting engagement with said drive means to thereby move said lug means rearwardly of said notches.

9. A key ejector lock which comprises:

a tubular barrel having an internal retaining shoulder adjacent its front end, the rear end of said barrel being slit longitudinally to provide for resilient expansion thereof, a tubular front end plug rotatably mounted in said barrel and having a keyway extending therethrough for operation thereof by a key, a rear end plug rotatably mounted in said barrel and adapted for operative connection to a locking member, interengaging circumferential ring and groove means on the slit end of said barrel and said rear end plug enabling relative rotation thereof, rotatable drive means interposed between said plugs and mounted for axial reciprocal movement in said barrel, means providing a sliding drive connection between said drive means and said rear end plug, means providing a sliding drive connection between said front end plug and said drive means, spring means interposed between said rear end plug and said drive means and resiliently urging said drive means forwardly in said barrel, means on said barrel providing rearwardly opening circumferentially spaced internal notches, lug means projecting outwardly from said drive means, said lug means being removably received in respective ones of said notches for securing said rear end plug in respective locked and unlocked rotational positions, a key ejector received in said front end plug for axial reciprocal movement therein between the front end plug and said drive means and engaged by a key inserted through said keyway, and spring means interposed between said drive means and said key ejector and resiliently urging said key ejector forwardly in said barrel, whereby the lock may be assembled by loading the barrel from its rear end with the rear end plug inserted in the barrel into snap-fitting interengagement of said ring and groove means, and insertion of a key in said keyway serves to move said key ejector rearwardly into abutting engagement with said drive means, to thereby move said lug means rearwardly of said notches and free the rotatable parts for rotation and enable the key to rotate said front end plug for rotation said rear end plug between said locked and unlocked positions thereof, and said key ejector acts to eject the key when released in any rotational position thereof.

10. A key ejector lock as defined in claim 9 and wherein said first-named spring means comprises a relatively heavy compression spring, and said last-named spring means comprises a relatively light compression spring.

11. A key ejector lock as defined in claim 9 and including means providing a circumferential groove on said rear end plug disposed forwardly beyond the slit portion of said barrel when assembled, and an O-ring mounted in the latter groove to provide a vapor barrier and minimize side play of the rear end plug.

12. A key ejector lock as defined in claim 9 and wherein said notch means provides at least two circumferentially spaced notches corresponding respectively to said locked and unlocked positions of said rear end plug, and at least one intervening notch in which said lug means is received when the key is ejected at a transitional position of said rear end plug between the locked and unlocked positions, to thereby prevent movement of the rear end plug into the locked position.

13. A key ejector lock as defined in claim 9 and wherein said barrel, plugs, drive means, and key ejector are constructed of synthetic thermoplastic material.

* * * * *